US005421750A

United States Patent [19]

Crotty

[11] Patent Number: 5,421,750

[45] Date of Patent: Jun. 6, 1995

[54] 200 AMP BOLTED ELBOW WITH A LOADBREAK TAP

[75] Inventor: David E. Crotty, Hackettstown, N.J.

[73] Assignee: Amerace Corporation, East Brunswick, N.J.

[21] Appl. No.: 248,169

[22] Filed: May 24, 1994

[51] Int. Cl.[6] ..... H01R 13/53

[52] U.S. Cl. ..... 439/801; 439/921

[58] Field of Search ..... 439/801, 921, 181–187

[56] References Cited

U.S. PATENT DOCUMENTS

| | | | |
|---|---|---|---|
| 4,186,985 | 2/1980 | Stepniak | 439/185 |
| 4,202,591 | 5/1980 | Borgstrom | 439/185 |
| 4,203,641 | 5/1980 | Siebens | 439/339 |
| 4,210,381 | 7/1980 | Borgstrom | 439/161 |
| 4,353,611 | 10/1982 | Siebens et al. | 439/475 |
| 4,354,721 | 10/1982 | Luzzi | 439/921 |
| 4,857,021 | 8/1989 | Boliver et al. | 439/801 |

*Primary Examiner*—Gary F. Paumen

*Attorney, Agent, or Firm*—David Teschner

[57] ABSTRACT

A method and apparatus for permanently boiling a 200 AMP cable to a bushing well stud and permitting a second cable to be selectively connected or removed. A bushing well stud extender is added to a bushing well stud and one arm of a T-shaped housing with reinforcement is placed within the bushing well. A high voltage cable with a connector having an unthreaded aperture in its lug is placed within the central vertical leg in line with the second end of the bushing well stud extender. An insert placed in the second arm has a threaded stud to fix the cable lug between the extender and the insert. The free end of the insert has loadbreak contacts and is shaded to receive an elbow connected to a second high voltage cable.

14 Claims, 6 Drawing Sheets

200 AMP BOLTED ELBOW WITH A LOADBREAK TAP

BACKGROUND OF THE INVENTION

1. Field of the Invention

The invention is directed to the interconnection of high voltage electrical cables and more particularly to a bushing tap which can be bolted to a bushing well, support a terminated cable by such bolt and provide a loadbreak interface for a second cable connected to the bushing tap by a standard cable elbow.

2. Description of the Prior Art

According to prior art techniques when it was desired to connect two cables to a single bushing well it was necessary to use a double bushing insert of the type shown in U.S. Pat. No. 4,203,641 issued May 20, 1980 and assigned to the assignee of the instant invention. It was necessary to use a bail arrangement as shown by the '641 to prevent the double bushing insert from being displaced from the bushing well due to high momentary currents. There are no known devices which permit a cable to be directly bolted to a bushing well.

U.S. Pat. No. 4,202,591 issued May 13, 1980 and assigned to the assignee of the instant invention shows the use of 600 AMP T-shaped connector which can be bolted to an appliance bushing and connect one cable to the bushing while receiving a second cable connected to an elbow. Because of the large size of the 600 AMP connector it is not possible to use it in the confined space available with 200 AMP systems. Also, no technique is shown in this type of device for connecting the connector to a bushing well.

A multi-position junction could also be used except for the space it requires.

Present interference fit bushing/elbow interfaces will not hold the connection between them in the presence of high momentary currents unless a bail similar to that shown in the '641 patent is used.

SUMMARY OF THE INVENTION

The instant invention overcomes the problems noted above by providing a bushing tap connector which can be directly bolted to a bushing well and at the same time support a first high voltage cable terminated in an apertured lug and receive a second high voltage cable mounted in an elbow at a loadbreak interface.

The bushing tap has a generally T-shape having a vertical center section with two in-line arms at right angles to the center section. Both arms and the center section have a bore running through which meet at the juncture of the arms with the central portion. A bushing well stud extension having internal threaded bores at both ends is threadedly mounted to the stud of a bushing well. One arm end is shaped and proportioned to fit in a bushing well while the well stud extension enters the bore. A first high voltage cable, terminated in a connector having a lug with an aperture therethrough, is inserted into the bore of center section and moved upwardly until the aperture of the lug is adjacent the second end of the bushing well stud extension. An insert having a threaded end section is placed in the second arm bore and inserted through the lug aperture into the second threaded bore of the bushing well stud extension to fix the first cable and the tap housing to the bushing well. The second end of the insert contains a loadbreak female contact arrangement and permits an elbow fixed to a second high voltage cable to be connected to the bushing tap second arm. It is an object of this invention to provide a device which permits a cable to be bolted to a bushing well.

It is an object of this invention to provide a device which permits a first high voltage cable to be bolted to a bushing well and receive a second high voltage cable at a loadbreak interface.

It is another object of this invention to provide a device which permits a first high voltage cable to be permanently bolted to a bushing well and a second high voltage cable to be selectively removed to permit testing or phasing of the first cable and the bushing well device.

It is a further object of this invention to provide a tap and elbow receiving connector which requires a minimum of space.

It is still another object of this invention to provide an improved housing for a bolted connection to a bushing well.

Other objects and features of the invention will be pointed out in the following description and claims and illustrated in the accompanying drawings, which disclose, byway of example, the principles of the invention, and the best mode presently contemplated for carrying them out.

BRIEF DESCRIPTION OF THE DRAWING

In the drawings in which similar elements are given similar reference characters.

DESCRIPTION OF THE PREFERRED EMBODIMENT

Figure 3:
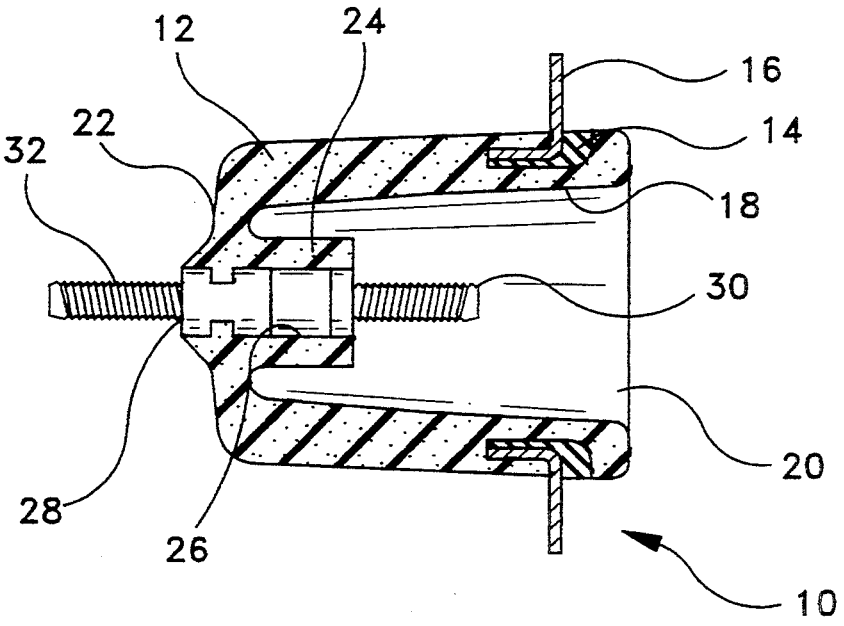
FIG.3 is a side elevational view, in section, of a bushing well to which the connector of the instant invention can be attached.

FIG. 3 shows a bushing well 10 of the type shown in U.S. Pat. No. 4,353,611 issued Oct. 12, 1982 and assigned to the assignee of the instant invention. Bushing well 10 has an insulative body 12 made of non-conductive elastomer, EPDM rubber or the like with shielding portions 14 of conductive elastomeric or EPDM rubber. A mounting ring 16 permits the bushing well 10 to be mounted upon the enclosure wall (not shown) of the electrical device the bushing well 10 is connected to. The enclosure wall could be a transformer casing. A hole (not shown) is cut in the casing and the bushing well 10 placed therein and the mounting ring 16 attached to such casing with suitable fasteners (not shown). A receptacle 18 extending from open end 20 is contoured and dimensioned to receive therein one end of a cross-arm of the bushing tap as will be described below. A built up hub 24 at closed end 22 has a bore 26 therethrough. Contact stud 28 extends into receptacle 18 and has a first externally threaded portion 30 in receptacle 18 and a second externally threaded portion 32. A transformer lead (not shown) can be attached to contact stud 28 portion 32 by means of suitable fasteners (not shown). In accepted practice, a bushing well insert would be threadedly connected to the portion 30 of bushing well 10 and a high voltage cable attached to an elbow would be connected to the other end of the insert but no cable would be directly bolted to the bushing well 10.

Figure 1:
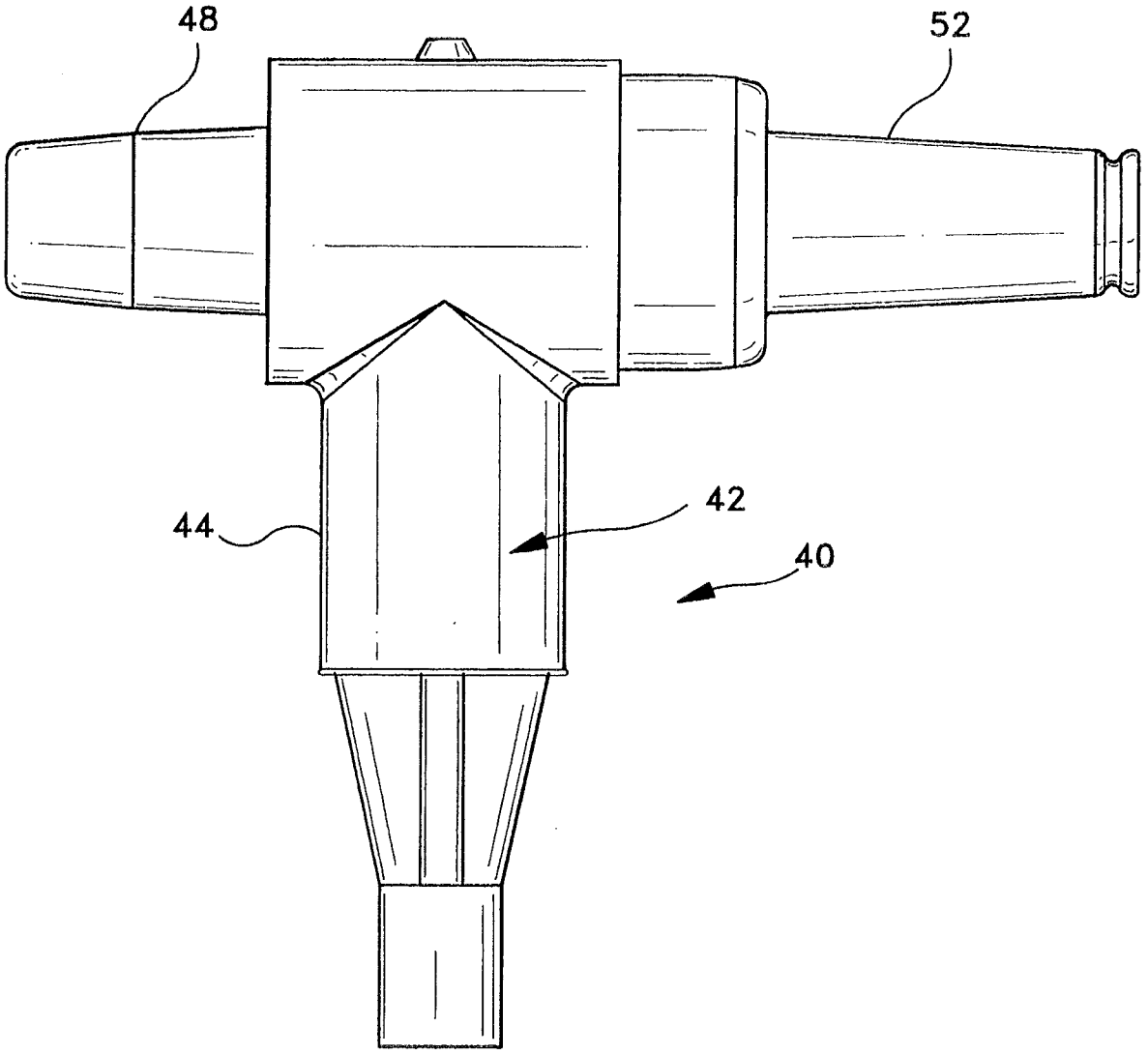
FIG. 1 is a side elevational view of a bushing tap device constructed in accordance with the concepts of the invention.

Turning now to FIG. 1 there is shown a bushing tap 40 constructed in accordance with the concepts of the invention. Bushing tap 40 has a generally T-shaped housing 42 having a central vertical portion 44, a horizontal cross-arm 48 extending to the left of central vertical portion 44 as seen in FIG. 1 and a horizontal cross-arm 52 extending to the right of central vertical portion 44.

Figure 5:
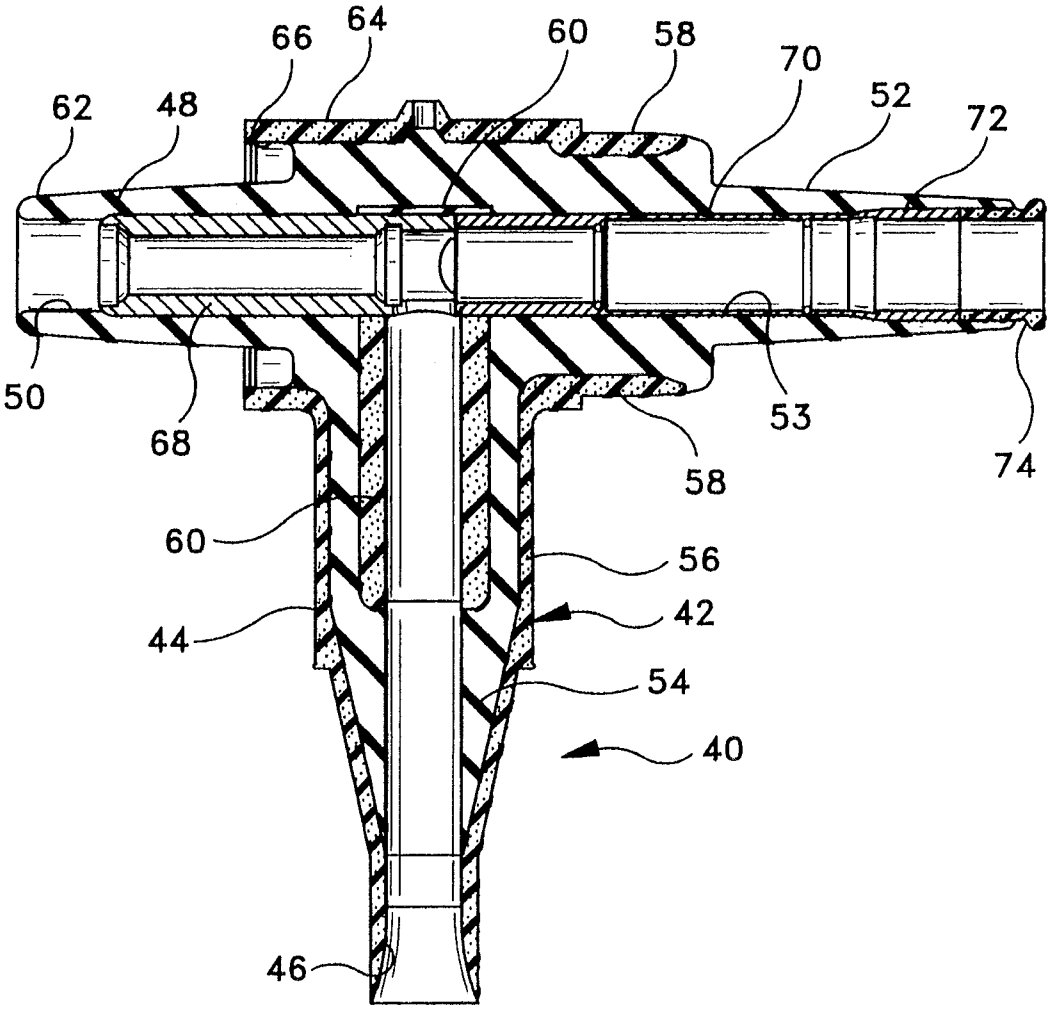
FIG. 5 is a side elevational view, in section, of the housing of FIG. 1.

As shown in FIG. 5 housing 42 is composed of a layer of insulation which may be non-conductive natural or synthetic rubber, elastomeric such as EPDM rubber. This is covered at selected locations by a layer of semi-conductive natural or synthetic rubber, elastomeric such as EPDM rubber to which lamp black has been added. The semi-conductive layer is positioned so as to provide a continuous shield when all components are assembled. Semi-conductive portion 56 provides a shield for central vertical portion 44 and continues the shield of a high voltage cable which is inserted into the bore 46 of central portion 44.

Semi-conductive portion 58 encircles portions of horizontal cross-arms 48 and 52 and connects with semi-conductive portion 56. The semi-conductive portion 58 on cross-arm 48 engages the shield layer 14 of bushing well 10 while the semi-conductive portion 58 on cross-arm 52 engages the semi-conductive layer of the cuff of the applied elbow. A semi-conductor portion 60 extends in bore 46 of portion 44 to engage the shield and insulation layers of the cable placed in bore 46.

Cross-arm 48 has a central bore, 50 and cross-arm 52 has a central bore 53. Bores 46, 50, and 53 meet at the midlines of vertical portion 44 and cross-arms 48 and 52. The free end 62 of cross-arm 48 is tapered to match the walls of the receptacle 18 of the bushing well 10. An annular recess 66 extends about portion 64 of arm 48 to receive therein the end wall of the bushing well 10 at end 20. An aluminum tube 68 is placed in central bore 50 to provide strength for cross-arm 48.

Cross-arm 58 also has a metal sleeve 70 in its bore 53 to provide a shield as will be described below. The free end 72 of cross-arm 58 is tapered to match the receptacle of the elbow (not shown) and has a detent recess 74 about its outer surface.

Figure 4:
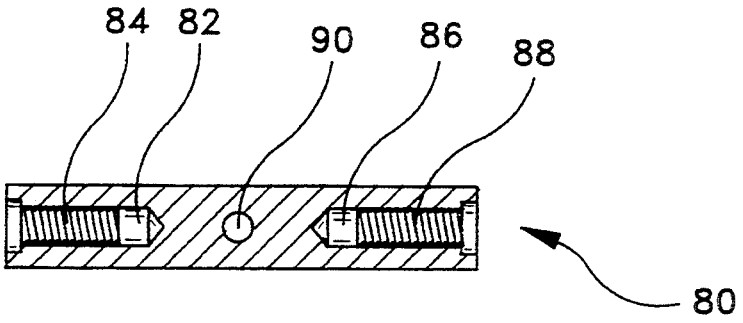
FIG. 4 is a side elevational view, in section, of a stud extender of the instant invention.

To use the bushing tap 40, a well stud extender 80 as shown in FIG. 4 is first installed on the stud portion 30 of bushing well 10. Well stud extender 80 is a cylindrical, solid metal part which has a bore at each end extending towards the center. Bore 82 is internally threaded as at 84 and bore 86 is internally threaded as at 88. Since threaded portions 84, 88 are of the same dimension, well stud extender 80 does not have to be oriented before use. A central cross bore 90 permits well stud extender 80 to be applied to threaded portion 30 of stud 28 using pin wrenches or the like to obtain the desired torque.

Figure 6:
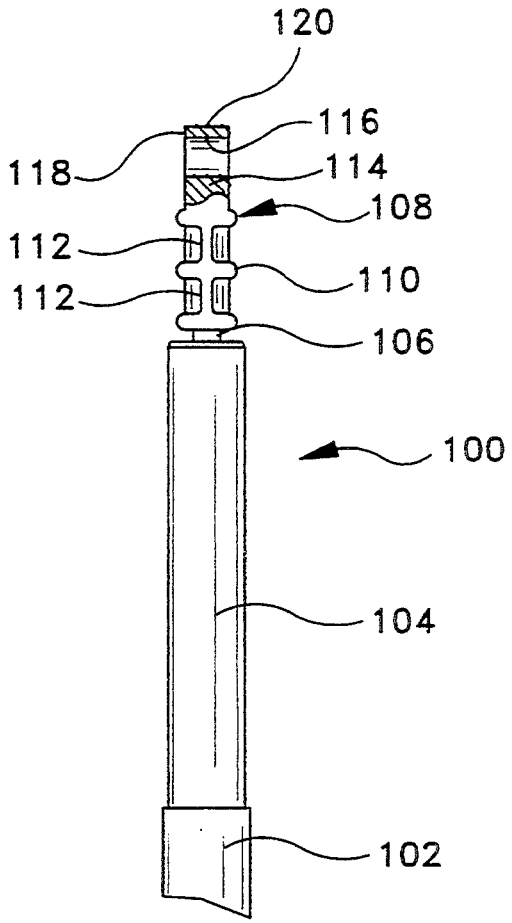
FIG. 6 Is a side elevational view, partially in section, of a high voltage cable terminated in an apertured lug.

Next the high voltage cable 100 shown in FIG. 6 must be prepared. A length of the outer shield 102 is removed to expose the insulation layer 104. Then a length of the insulation layer 104 is removed to expose the metallic central conductor 106. To the exposed central conductor 106 a connector 108 is applied. The exposed central conductor 106 is placed in the crimp barrel 110 of connector 108 and the barrel 110 is crimped onto the conductor using a suitable tool and dies as is well known in the art. The crimping operation results in a number of crimp indentations 112 along barrel 110. The remaining portion of connector 108 is lug 114 which has an unthreaded aperture 116 extending through it.

The bushing tap 40 is now fitted to the bushing well 10. The tapered end 62 of cross-arm 48 fit into the receptacle 18 and the well stud extender 80 extends through bore 50 and tube 68. The prepared high voltage cable 100 with connector 108 installed is introduced into bore 46 of central vertical portion 44 and advanced until the end of lug 114 engages the semi-conductive layer 60 at the end of bore 46. The left face 118 of lug 108 is against the end of well stud extender 80 and the aperture 116 is in line with bore 86. To lock the connector 108 and thus cable 100 in place the externally threaded stud 132 of insert 130 is employed. Threaded stud 132 passes through unthreaded aperture 116 in lug 114 of connector 108 and enters the bore 86 of well stud extender 80 and engages the threads 88 and is further engaged as the insert 130 is rotated using pin wrenches (not shown) to achieve the desired torque. When the insert 130 is properly positioned shoulder 134 of insert 130 will rest against right face 120 of lug 114 holding the lug 114 between the end of well stud extender 80 and the shoulder 134 of insert 130.

Figure 2:
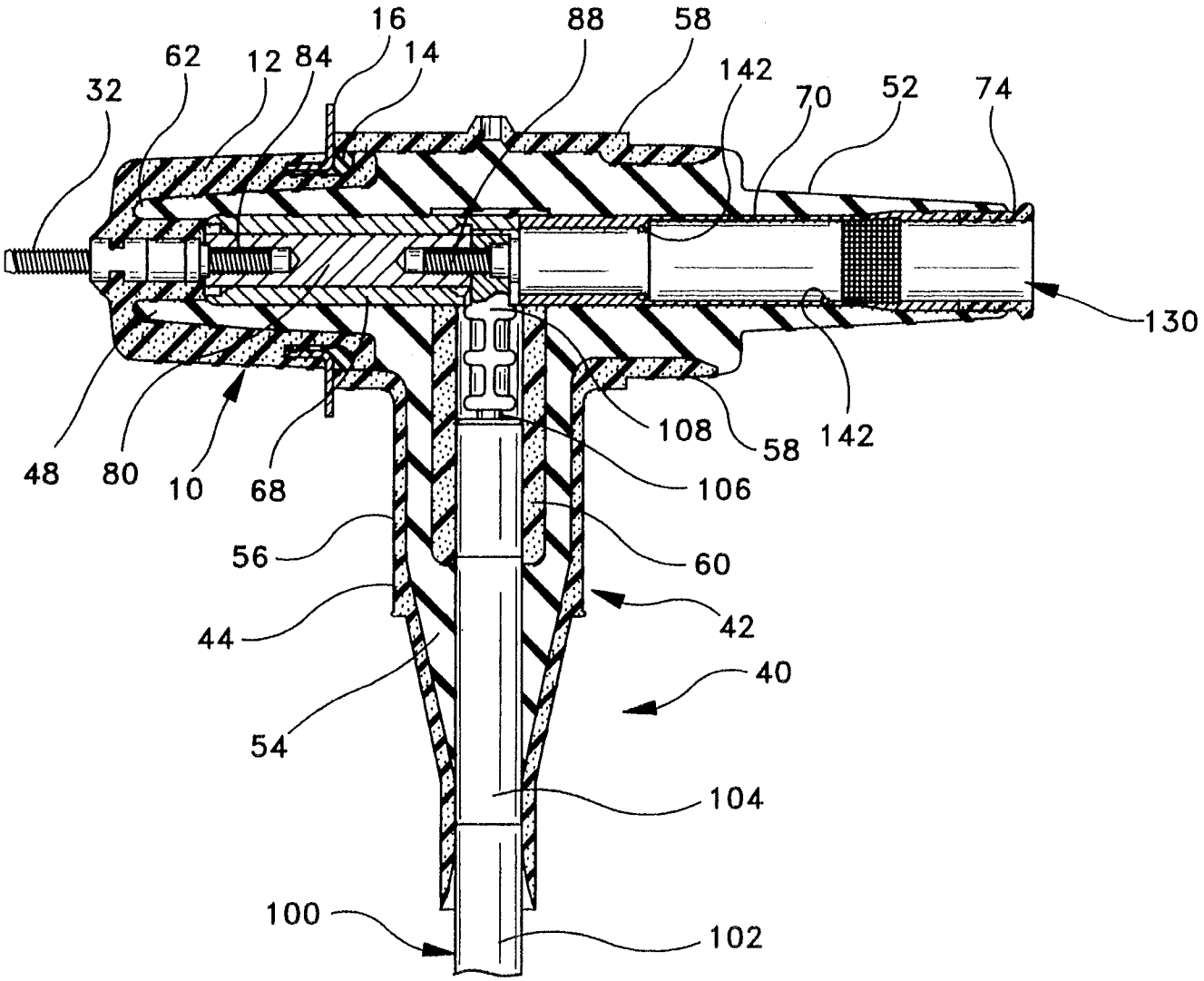
FIG. 2 is a side elevational view, in section, of the housing of FIG. 1 installed upon a bushing well and having a terminated high voltage cable bolted to such bushing well within the housing.
Figure 7:
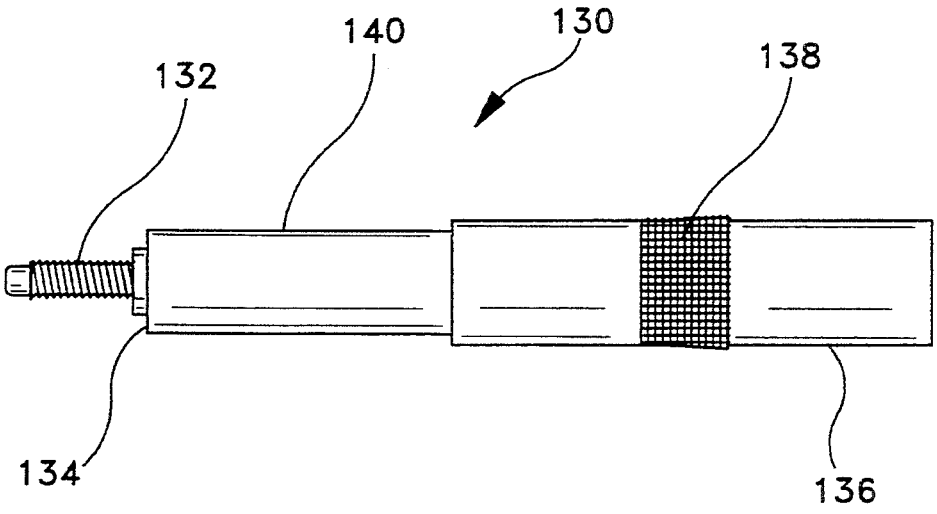
FIG. 7 is a side elevational view of the insert of the instant invention.

Insert 130, as shown in FIGS. 2 and 7 has a first cylindrical portion 136 which houses the female load-break contacts as is best seen in U.S. Pat. No. 4,186,985 issued Feb. 5, 1980 and assigned to the assignee of the instant invention to which reference is made. A series of seriation 138 about the center surface of portion 136 anchors insert 130 in bore 53 of cross-arm 52. A second cylindrical portion 136 has an end wall to which is mounted threaded end 132 and which creates shoulder 134. O-ring seals 142 are placed about cylindrical portions 136 and 140 and in contact with metal sleeve 70.

Figure 8:
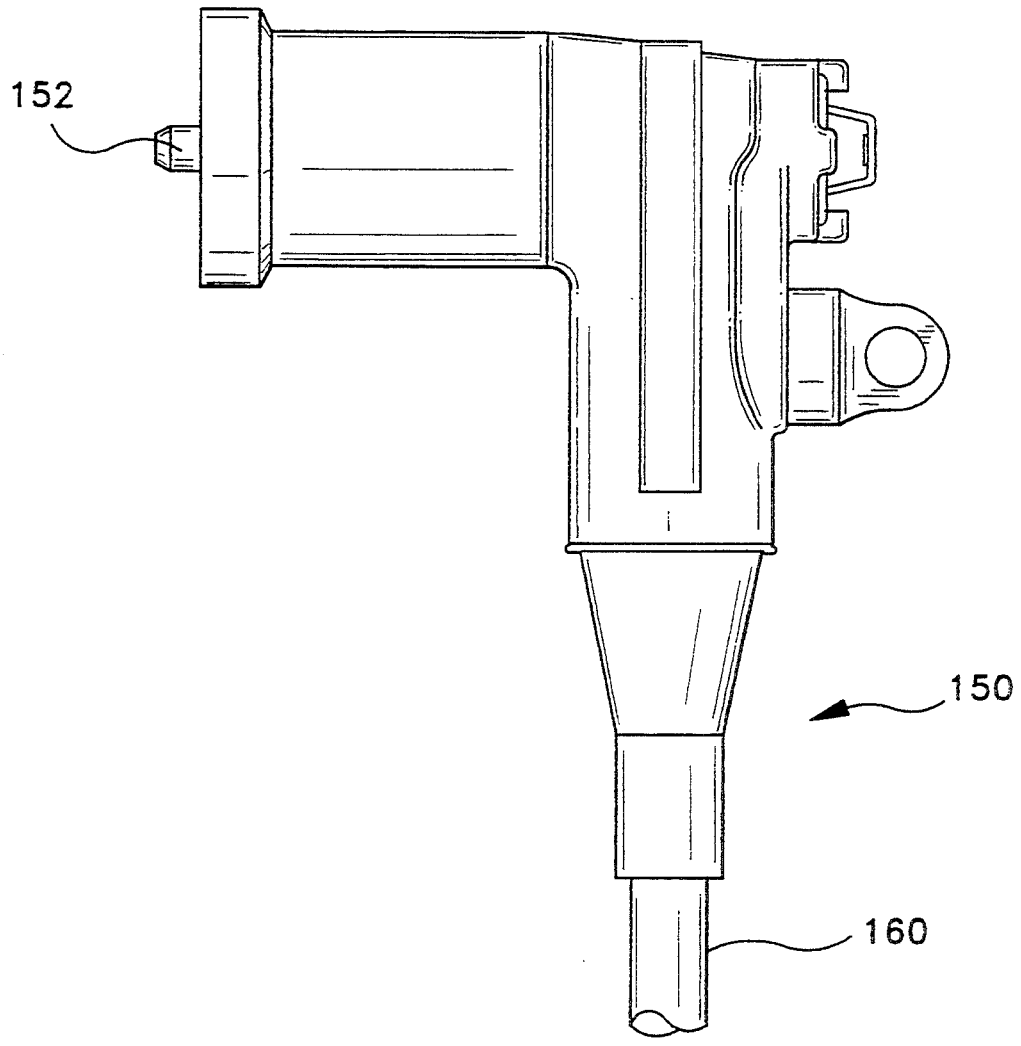
FIG. 8 is a side elevational view of an elbow with a high voltage cable attached with can be installed on the bushing tap of FIG. 1.

To the cross-arm 52 an elbow connector 150 as shown in FIG. 8 may be applied. The connector 150 is connected to a further high voltage cable 160 and is applied to end of cross-arm 52. The probe 152 engages the female contacts within insert 130 and the tapered end 72 mates with the receptacle of the elbow 150 and a rib in that receptacle enters detent groove 74 to fix elbow 150 to cross-arm 52. An elbow of the type generally described is shown and described in more detail in U.S. Pat. No. 4,210,381 issued Jul. 1, 1980 and by this reference made a part hereof.

The cable 100 may be used for underground rural distribution and is often identified as a URD cable. With this arrangement the URD cable may remain bolted to the bushing well while cable 160 is removed to permit the bushing well 10 and cable 100 to be tested and to control the phasing of the cables 100 and 160.

While there have been shown and described and pointed out the fundamental novel features of the invention as applied to the preferred embodiments, it will be understood that various omissions and substitutions and changes of the form and details of the device illustrated and in its operation may be made by those skilled the art, without departing from the spirit of the invention.

The embodiments of the invention in which an exclusive property or privilege is claimed are defined as follows:

1. A device for coupling at, least one high voltage cable to a bushing well having a body of insulating material and an internal cavity from an open first end to a closed second end and an externally threaded stud projecting into said cavity from a hub extending into said cavity from said closed second end said device comprising:

a) a T-shaped body having a first cross-arm with a first central bore extending from a first end to a second end, a second cross-arm with a second central bore extending from a third end to a fourth end, and a vertical member having a third central bore extending from a fifth end to a sixth end; said first cross-arm second end, said second cross-arm third end and said vertical member fifth end joined to form said T-shaped body and said first, said second and said third central bores connecting with one another within the joint formed by said cross-arms and said vertical member;

b) a bushing well stud extender having internal threads coupled to said bushing well stud; said bushing well stud extender passing through said first central bore into said third central bore when said first end of said first cross-arm is positioned in said cavity of said bushing well;

c) a high-voltage cable, having a seventh end and an eighth end, adapted to be positioned in said third central bore with said seventh end adjacent said first and second central bores; and d) coupling means having a ninth end and a tenth end, adapted to have said ninth end inserted through said second bore at said fourth end of said second cross-arm and advanced towards said third end of said second cross-arm to couple said seventh end of said high voltage cable to said bushing well stud extender.

2. A device as defined in claim 1, wherein said bushing well stud extender is a rod of conductive metal.

3. A device as defined in claim 2, wherein said bushing well stud extender has an eleventh end and a twelfth end, said bushing well extender having a first internally threaded bore adjacent said eleventh end to receive therein at least a portion of said externally threaded stud of said bushing well.

4. A device as defined in claim 3, wherein said bushing well stud extender has a second internally threaded bore adjacent said twelfth end.

5. A device as defined in claim 4, wherein said coupling means ninth end has an externally threaded portion to mate with said second internally threaded bore of said bushing well extender.

6. A device as defined in claim 1, further comprising:

a) A connector having a conductor engaging barrel to receive said seventh end of said cable therein and a lug, said lug having an unthreaded aperture therethrough whereby said ninth end of said coupling means passes through said aperture to engage said bushing well stud extender.

7. A device as defined in claim 5, further comprising:

a) A connector having a conductor engaging barrel to receive said seventh end of said cable therein and a lug, said lug having an unthreaded aperture therethrough whereby said ninth end of said coupling means passes through said aperture to engage said second internally threaded bore of said bushing well stud extender.

8. A device as defined in claim 6, wherein:

a) said lug has a first face and second face;

b) said bushing well stud has an eleventh end and twelfth end;

c) said coupling means has a shoulder adjacent said ninth end; and d) said first face of said lug is positioned in contact with said twelfth end of said bushing well stud extender and said second face of said lug is in contact with said shoulder of said coupling means to fix the position of said seventh end of said high voltage cable with respect to said device.

9. A device as defined in claim 7, wherein:

a) said lug has a first face and a second face;

b) said bushing well stud has an eleventh end a twelfth end;

c) said coupling means has a shoulder adjacent said ninth end; and d) said first face of said lug is positioned in contact with said twelfth end of said bushing well stud extender and said second face of said lug is in contact with said shoulder of said coupling means to fix the position of said seventh end of said high voltage cable with respect to said device.

10. A device as defined in claim 1, wherein said first end of said first cross-arm is contoured to fit within said bushing well cavity about said hub.

11. A device as defined in claim 1, wherein said first central bore in said first cross-arm is lined with a hollow metal sleeve.

12. A device as defined in claim 1, wherein said first end of said first cross-arm is contoured to fit within said bushing well cavity about said hub and said first central bore in said first cross-arm is lined with a hollow metal sleeve.

13. A device as defined in claim 1, wherein said tenth end of said coupling means is contoured to receive a separable elbow coupled to a further high voltage cable whereby two high voltage cables can be coupled to said bushing well.

14. A device as defined in claim 6, wherein said tenth end of said coupling means is contoured to receive a separable elbow coupled to a further high voltage cable whereby two high voltage cables can be coupled to said bushing well.

* * * * *

UNITED STATES PATENT AND TRADEMARK OFFICE

CERTIFICATE OF CORRECTION

PATENT NO. : 5,421,750
DATED : June 6, 1995
INVENTOR(S) : Crotty

It is certified that error appears in the above-indentified patent and that said Letters Patent is hereby corrected as shown below:

Abstract, line 14, "shaded" should read --shaped --.

Signed and Sealed this

Twenty-ninth Day of August, 1995

Bruce Lehman

*Attest:*

BRUCE LEHMAN

*Attesting Officer*

*Commissioner of Patents and Trademarks*